US010384832B2

(12) United States Patent
Johnson

(10) Patent No.: US 10,384,832 B2
(45) Date of Patent: Aug. 20, 2019

(54) FLIP BOTTLE

(71) Applicant: Imagen Brands, LLC, Mason, OH (US)

(72) Inventor: Matthew Johnson, Mobile, AL (US)

(73) Assignee: Imagen Brands, LLC, Mason, OH (US)

( * ) Notice: Subject to any disclaimer, the term of this patent is extended or adjusted under 35 U.S.C. 154(b) by 0 days.

(21) Appl. No.: 15/415,875

(22) Filed: Jan. 26, 2017

(65) Prior Publication Data

US 2017/0217635 A1 Aug. 3, 2017

Related U.S. Application Data

(60) Provisional application No. 62/288,372, filed on Jan. 28, 2016.

(51) Int. Cl.

| | |
|---|---|
| ***B65D 21/08*** | (2006.01) |
| ***B65D 21/02*** | (2006.01) |
| ***B65D 1/02*** | (2006.01) |
| ***B65D 41/04*** | (2006.01) |

(52) U.S. Cl.

CPC ..... *B65D 21/08* (2013.01); *B65D 1/02* (2013.01); *B65D 21/0228* (2013.01); *B65D 21/0234* (2013.01); *B65D 41/0442* (2013.01)

(58) Field of Classification Search

CPC ..... B65D 21/0209; B65D 21/0228; B65D 21/0234; B65D 21/08; B65D 81/3841; B65D 81/3869

See application file for complete search history.

(56) References Cited

U.S. PATENT DOCUMENTS

| | | | | |
|---|---|---|---|---|
| 779,749 | A * | 1/1905 | Tinling | A61J 9/00 215/11.1 |
| 2009/0071925 | A1* | 3/2009 | Lackey | B65D 21/0233 215/10 |
| 2010/0288759 | A1* | 11/2010 | Hotell | B65D 7/04 220/23.83 |
| 2012/0091131 | A1* | 4/2012 | Arjomand | B65D 7/04 220/4.01 |

OTHER PUBLICATIONS

Crown Products, Twice Around TritanDrinkware Bottle, Web advertisement.
Crown Products, Orbit Tumbler, Web advertisement.
Geometric Stainless Sports Bottle, Web advertisement.
Discount Embrodery Blanks, Embroidery/Photo Insert Slurpy Tumbler with Straw, Web advertisement.
Crown Products, Tip Top Drinkware—Tumbler, Web advertisement.

* cited by examiner

*Primary Examiner* — Mollie Impink
(74) *Attorney, Agent, or Firm* — Bradley Arant Boult Cummings LLP

(57) ABSTRACT

A reconfigurable container is provided that includes an inner and outer wall where the inner wall may be disconnected from the outer wall, inverted and re-attached to form a container having a larger volume. The outer wall and the inner wall are detachably attached by a locking ring that secures the inner wall and outer wall in fluid tight engagement. The reconfigurable container allows for different usage modes, for example, as an open top container and as an enclosed single wall container.

12 Claims, 4 Drawing Sheets

FLIP BOTTLE

This application claims priority from provisional patent application Ser. No. 62/288,372 filed Jan. 28, 2016 entitled FLIP BOTTLE.

FIELD OF INVENTION

The present invention relates to reconfigurable containers and more particularly this invention relates to alternative utilitarian use of the inner wall of a double wall container. In greater particularity the present invention relates to the class of double wall containers describe generally as tumblers or glasses. More particularly, the present invention relates to a double walled container wherein the inner wall can be separated from the outer wall and reattached in an inverted position, thereby transforming an open topped double wall container into a single wall container with increased size and volume.

BACKGROUND

Double wall containers consist of an outer and inner wall separated by an air space. This air space often functions as a thermal barrier of varying efficiency depending on the construction methods and materials of the container item. In most cases, the inner wall and outer wall are permanently fixed to each other and cannot be separated. There are a variety of double wall containers on the market including: standard double wall drinkware which is a very common style of drinkware using and inner and outer wall bonded together as exemplified by the Orbit® tumblers sold by the assignee of this application; Leeds Geometric Stainless Sports Bottle in which a stainless steel inner liner is removably attached to an acrylic bottle such that the stainless steel inner liner is removable for easy cleaning or use of the acrylic bottle without the liner; Screw on Insert Drinkware which is regular double wall drinkware but the inner and outer walls screw together so that the end user can insert their own imagery. The top part screws off to slide a photo in; The Hooler which is actually a can holder type drinkware that uses the space between a can and outer wall to fill with ice & water to quickly chill a drink; the Twice Around Tritan Bottle which is a style of drinkware that has a small opening for sipping and a larger opening for inserting ice cubes.

SUMMARY OF THE INVENTION

The present product improves and advances the art providing a container with a removable inner wall that can be reoriented in regard to the outer wall. The purpose of the reorientation is threefold:

1. To convert the item from an open top container such as a drinking glass or tumbler to an enclosed container such as a water bottle.
2. To increase/decrease the volumetric capacity of the container to suit various usage needs.
3. To decrease the overall size of the container for more efficient storage and transport.

This reorientation can be freely made from half-size double wall to full-size single wall as often as the user wishes. The conversion is made by removing a locking ring that secures the two walls together. The inner wall is then inverted, placed back on top of the outer wall and secured in the new position with the same locking ring. The single-wall configuration of the design increases the interior volume of the container.

BRIEF DESCRIPTION OF THE DRAWINGS

Referring to the drawings which are appended hereto and which form a portion of this disclosure, it may be seen that.

DETAILED DESCRIPTION

Figure 1:
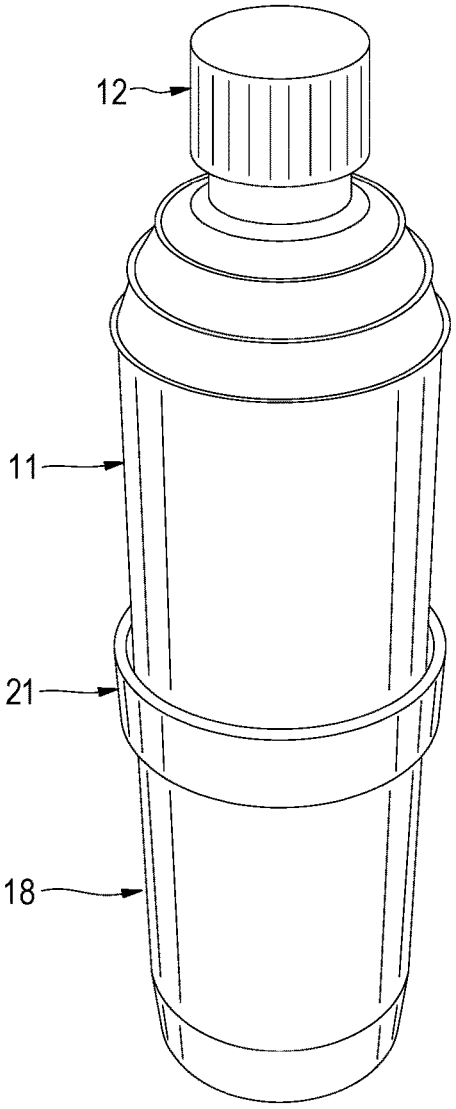
FIG. 1 is perspective view of the product configured as an enclosed single wall container.

Referring to the drawings for a clearer understanding of the invention it may be understood that the core aspect of this product concerns the separation and inversion of the inner wall to change the form and use of the container and/or provide a secondary use within the same item. The drawings depict the product as a drinkware item that will hold liquids, however, the structure could be applied to a wide array of containers and uses. To that end we believe the product has numerous advantages:

1. Two different usage modes, namely as an open top container or as an, enclosed single wall container;
2. Customer access to the space between the inner and outer wall for cleaning, storage of small items/liquid, or decorative inserts;
3. Reduced size for storage; and,
4. Reduced size for shipping.

Figure 2:
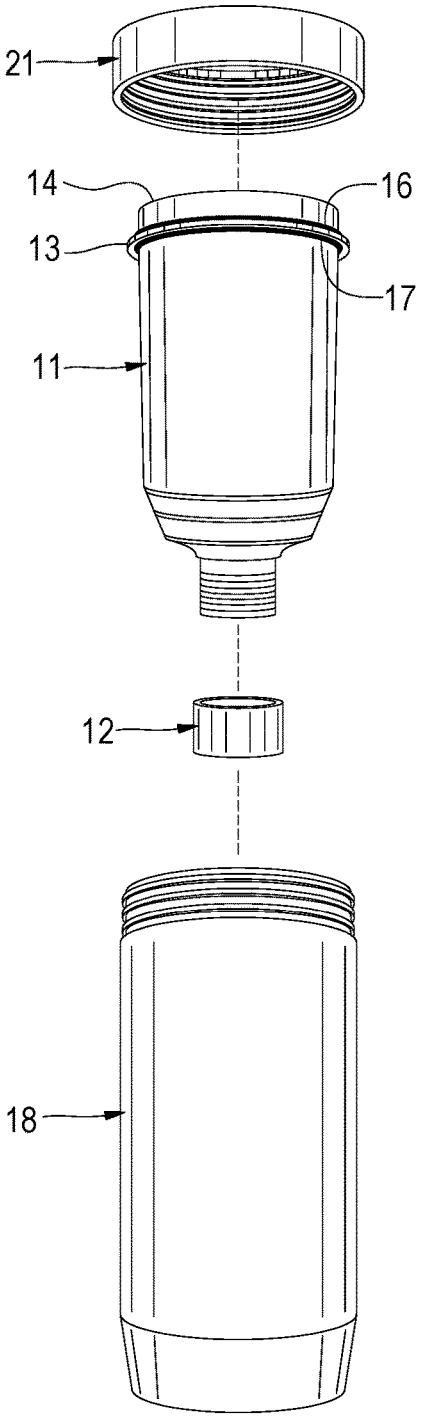
FIG. 2 is an exploded view of the components separated from one another.
Figure 3:
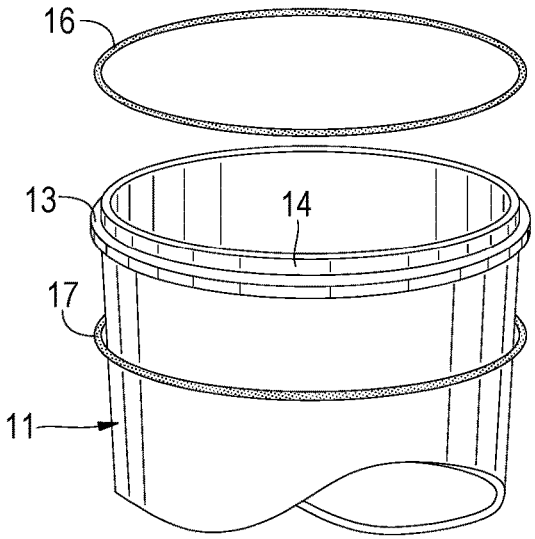
FIG. 3 is a perspective view of the flanged end of the inner shell in one embodiment.
Figure 4:
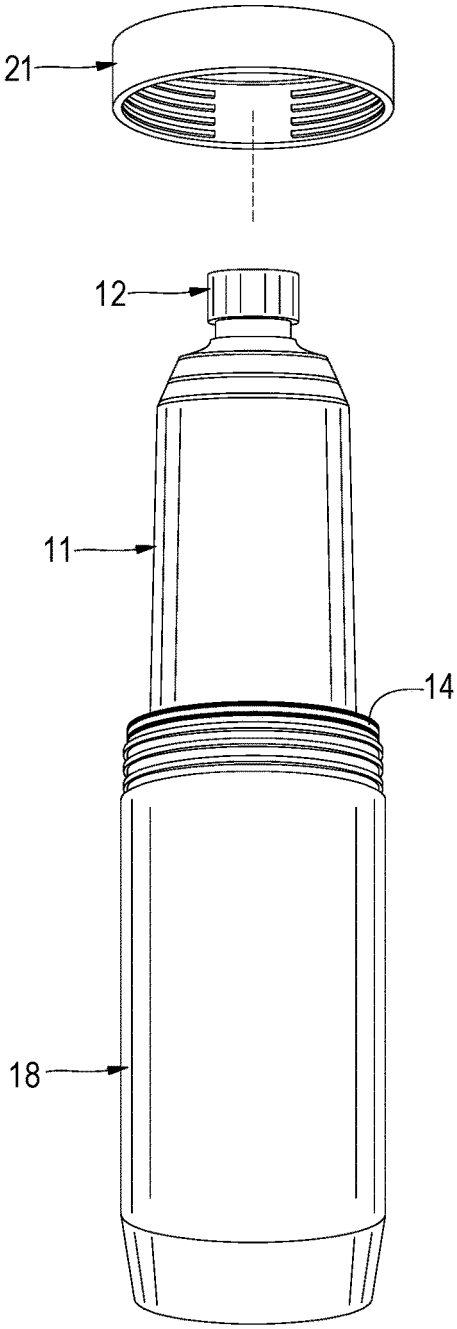
FIG. 4 is perspective view of the inner shell inverted over the outer shell with the peripheral closure removed.
Figure 5:
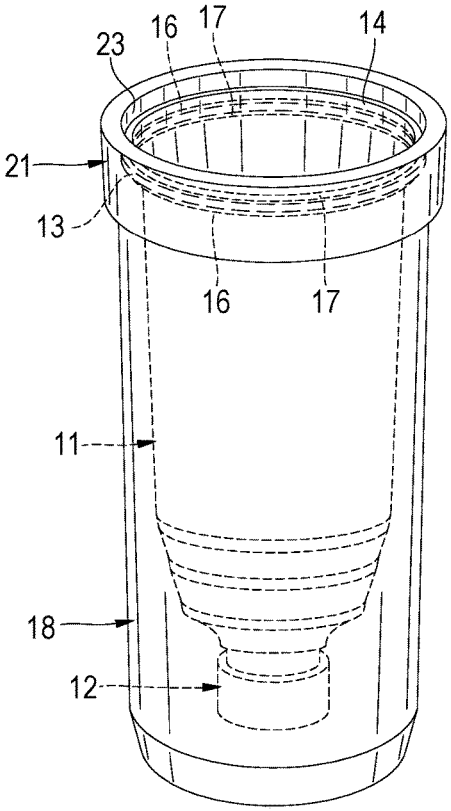
FIG. 5 is a perspective view of the inner and outer shell joined by the peripheral closure in a tumbler configuration.
Figure 7:
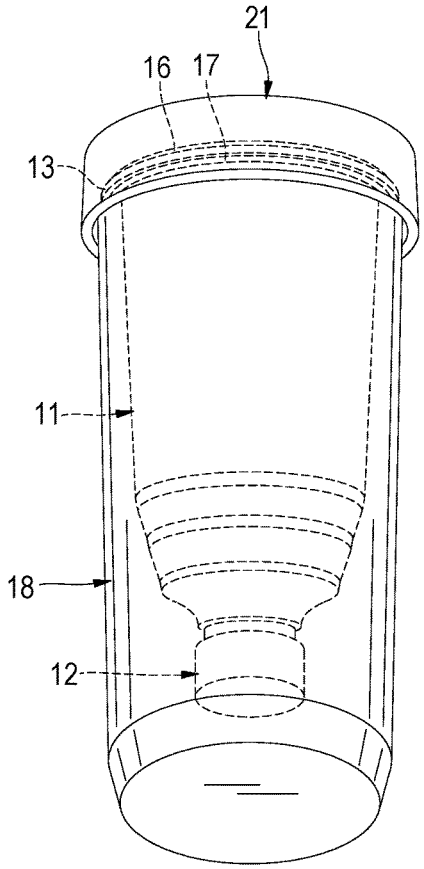
FIG. 7 is a perspective view of the product in a tumbler configuration; and, FIG. 8 is a depiction of the locking ring screwing onto the outer shell with the inner shell in the tumbler position.
Figure 8:
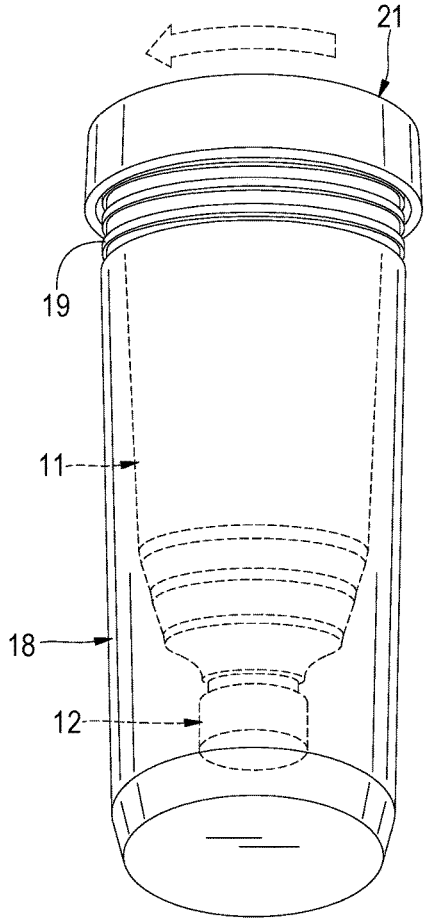

Again referring to the drawings, it will be noted in FIG. 1 and FIG. 7 that the product may be configured as a bottle or a tumbler. Referring to FIG. 2, note that the product includes an inner wall or shell 11. When configured as a bottle the inner wall also defines an opening to which a closure 12 or bottle cap can be releasably affixed. Closure 12 is conventionally configured with a separate silicone gasket in prevent leakage. When configured as a tumbler, closure 12 is secured to inner shell 11 to seal the opening and retain liquid within the inner shell. Referring to FIG. 3 and FIG. 5 it will be noted that the inner shell 11 includes a peripheral sealing flange 13 extending outwardly therefrom. In the embodiment shown, a rim 14 extends the shell beyond the peripheral sealing flange 13 to interface and register with an outer wall 18 in both the regular and inverted position. Rim 14 and defines a first seat for a first sealing gasket 16. A second sealing gasket 17 is also captured in a seat formed on the opposite side of peripheral sealing flange 13. The peripheral sealing flange 13 provides a surface to compress the sealing gaskets and functionally prevent leaks. It is noteworthy to mention that a sealing gasket may alternatively be carried by the outer wall or shell 18 in position to be compressed against flange 13 in either configuration, thereby eliminating the need for double seals.

Figure 6:
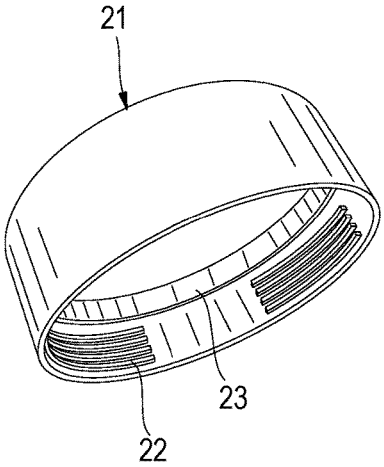
FIG. 6 is a bottom perspective view of the peripheral closure.

The outer wall or outer shell 18 serves as the base and lower container portion of the item. It will be noted that the outer shell 18 has a reduced diameter threaded region 19 circumscribing its upwardly opening top. Threaded region 19 releasably engages a peripheral mechanical closure or locking ring 21 which functions to tightly secure the inner and outer shells together in both configurations. This part is required to hold the inner and outer walls together in the appropriate positions. It also is responsible for creating compression of the silicone gaskets to create a water tight seal. Referring to FIGS. 5 to 7 it may be seen that locking ring 21 includes a lower threaded portion 22 that engages threaded region 19 of outer shell 18. The threaded portion 22 has an inside diameter or dimension that is greater than the outside diameter or dimension of peripheral sealing flange 13 whose outer diameter or dimension is substantially the same as threaded region 19 such that peripheral sealing flange 13 will be supported on threaded region 19 with one of the sealing gaskets 16 or 17 positioned between the flange 13 and threaded region 19. Locking ring 21 also includes an inner protrusion 23 that has an inner dimension less than the outer diameter of peripheral sealing flange 13 formed such that the inner protrusion bears against the peripheral sealing flange 13 when the threaded region 19 is fully engaged by threaded portion 22 of locking ring 21 compressing at least one of the gaskets 16 and 17 and sealingly securing the inner shell 11 to the outer shell 18 in either the tumbler or bottle configuration.

In its simplest form the invention requires: a detachable inner wall or shell that can be inverted and repositioned on outer wall; an outer wall or shell that can interface in multiple positions with the inner wall; and a mechanical coupler to secure the inner and outer walls together in multiple orientations.

Potential products using the teachings of this disclosure are not restricted to holding liquids only, but may be used with various items that will fit within the interior volume of the container are envisioned. The physical form of the invention could be modified to take on different aesthetic and functional designs in response to different customer needs. The invention is also not restricted by size. The scale could be very small, such as to hold medication or beads, or large such as to hold 64 oz of beer i.e. growler, or even a bathtub.

Products made in accordance with this invention are not required to have an opening with a closure or bottle cap on the inner shell. The inner wall could be enclosed on one end similar to the outer wall. There are useful applications to having both walls enclosed on one end, for example, the storage of a t-shirt or other small promotional items within the closed bottle which can be converted into a tumbler after the promotional item is removed. Likewise products made in accordance with this disclosure are not restricted to material. The disclosed embodiments may be made of acrylic, other plastics or metals and other materials that lend themselves to container utilization. In an embodiment made of stainless steel, it may be possible to create a vacuum sealed version that adds extra thermal protection.

Although the illustrated embodiments disclose the use of sealing gaskets, the products made in accordance with this disclosure are not required to be water tight. The most common use will probably be to have a water tight design, but storage of non-liquid items will not require it. The watertight design may be accomplished as disclosed with the gaskets, or the peripheral sealing flange may be configured to create a labyrinth type seal with the mechanical closure and or the outer shell.

In another embodiment, the locking ring could be eliminated if the inner and outer wall were to have threads molded directly into the parts. This would, in our opinion, make for a less desirable and comfortable lip to drink from when used a drinking tumbler. This might also remove the need for the two silicone gaskets. The method for securing the inner and outer walls could also be redesigned to be more complicated than the current version.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

I claim:

1. A reconfigurable container comprising an inner wall and an outer wall configurable in an open top orientation and an enclosed orientation, wherein the inner wall is positioned inside the outer wall in the open top orientation, and the inner wall can be disconnected from the outer wall, inverted and attached to form the enclosed orientation, wherein:

the outer wall and the inner wall are detachably attached by a peripheral closure securing the inner wall and outer wall in fluid tight engagement in the enclosed orientation, the inner wall is circumscribed by a peripheral flange extending outwardly therefrom, the inner wall comprises a first gasket mounted above the peripheral flange and a second gasket mounted below the peripheral flange for compression by the peripheral closure, and the peripheral closure comprises a ring threadedly engaging a threaded region formed on the outer wall and abutting the peripheral flange circumscribing the inner wall to selectively compress the first and second gaskets against the peripheral flange.

2. A reconfigurable container as described in claim 1 wherein the outer wall includes a bottom to define a first cavity and the first cavity opens opposite of the bottom.

3. A reconfigurable container as described in claim 2 wherein the inner wall surrounds an opening having a detachable closure element attached thereto.

4. A reconfigurable container as described in claim 1 wherein the peripheral flange and the threaded region each have an outer dimension and the outer dimension of the peripheral flange is equal to the outer dimension of the threaded region.

5. A reconfigurable container as described in claim 1 wherein the outer wall has a reduced diameter in the threaded region.

6. A reconfigurable container as described in claim 5 wherein the inner wall surrounds an opening having a sealing bottle cap element attached thereto.

7. A reconfigurable container as defined in claim 1 wherein the inner wall defines an opening distal the peripheral flange, and further comprising a detachable closure for selectively sealing the opening, whereby the inner wall can be selectively connected to the outer wall with the detachable closure positioned between the inner and outer wall.

8. The reconfigurable container of claim 1, wherein the ring comprises interior threading and the interior threading is segmented.

9. The reconfigurable container of claim 1, wherein the threaded region extends along an exterior surface of the outer wall.

10. A sealable container comprising:

an inner shell and an outer shell having a rim, wherein the inner shell and the outer shell are configurable in an open top orientation and an enclosed orientation, the inner shell is positioned inside the outer shell in the open top orientation, and the inner shell can be disconnected from the outer shell, inverted, and attached to form the enclosed orientation, wherein the inner shell comprises a peripheral flange extending outwardly therefrom, a first gasket resting atop the peripheral flange, and a second gasket mounted below the peripheral flange; and, a ring having interior threading to threadedly engage a threaded region formed on the outer shell and abutting the first gasket and the second gasket to releasably secure the inner shell to the outer shell, wherein the first and second gaskets are compressible by threaded engagement of the ring with the outer shell, and wherein the interior threading of the ring is segmented.

11. A sealable container as defined in claim 10 wherein the inner shell defines an opening distal the peripheral flange, and further comprising a detachable closure for selectively sealing the opening, whereby the inner shell can be selectively connected to the outer shell with the detachable closure positioned between the inner and outer shell in the open top orientation.

12. The sealable container of claim 10, wherein the threaded region extends along an exterior surface of the outer wall.

* * * * *